US010479635B1

(12) United States Patent
Yu Chen

(10) Patent No.: US 10,479,635 B1
(45) Date of Patent: Nov. 19, 2019

(54) STRETCH FILM DISPENSER WITH TENSION ADJUSTMENT DEVICE

(71) Applicant: Hsiu-Man Yu Chen, Taichung (TW)

(72) Inventor: Hsiu-Man Yu Chen, Taichung (TW)

( * ) Notice: Subject to any disclaimer, the term of this patent is extended or adjusted under 35 U.S.C. 154(b) by 0 days.

(21) Appl. No.: 16/112,765

(22) Filed: Aug. 26, 2018

(51) Int. Cl.
*B65H 23/182* (2006.01)
*B65H 16/00* (2006.01)

(52) U.S. Cl.
CPC ..... *B65H 23/1825* (2013.01); *B65H 16/005* (2013.01)

(58) Field of Classification Search
CPC .... B65H 16/06; B65H 16/106; B65H 16/005; B65H 2402/412
See application file for complete search history.

(56) References Cited

U.S. PATENT DOCUMENTS 4,102,513 A * 7/1978 Guard ..... B65B 67/085 156/577
4,166,589 A * 9/1979 Hoover ..... B65B 67/085 156/577
4,535,951 A * 8/1985 Riemenschneider, III ..... B65B 67/085 242/423.2
4,714,211 A * 12/1987 Hwang ..... B65B 67/085 242/423.1
5,779,179 A * 7/1998 Zentmyer ..... B65B 67/085 242/423.2
6,883,298 B2 * 4/2005 Gooding ..... B65B 67/085 156/574
6,920,742 B1 * 7/2005 Yu Chen ..... B65B 67/085 156/574
7,228,677 B2 * 6/2007 Yu Chen ..... B65B 67/085 242/570
7,357,349 B1 * 4/2008 Huang ..... B65B 67/085 242/405.3
8,317,124 B2 * 11/2012 Yu Chen ..... B65B 67/085 242/588.6
10,059,548 B2 * 8/2018 Chen ..... B65H 23/14
10,167,101 B2 * 1/2019 Yu Chen ..... B65B 67/08
2002/0038838 A1 * 4/2002 Marois ..... B65H 16/06 242/596.6
2003/0208994 A1 * 11/2003 Gooding ..... B65B 67/085 53/557
2011/0233321 A1 * 9/2011 Yu Chen ..... B65B 67/085 242/588.2
2015/0353215 A1 * 12/2015 Yu Chen ..... B65H 16/005 53/203
2016/0340070 A1 * 11/2016 Yu Chen ..... B65B 67/08
(Continued)

*Primary Examiner* — William A. Rivera
(74) *Attorney, Agent, or Firm* — Bruce Stone LLP; Joseph Bruce

(57) ABSTRACT

A stretch film dispenser with a tension adjustment device includes a frame. The frame is provided with a film dispensing unit and the tension adjustment device. The tension adjustment device includes an adjustment rod. One end of the adjustment rod is threadedly connected with an adjustment unit. An elastic unit is connected between the frame and the film dispensing unit. When the adjustment unit rotates along the adjustment rod to generate downward axial displacement, the adjustment unit pushes the frame and the elastic unit to press the film dispensing unit, so that the film dispensing unit can be quickly adjusted in a different tension state when the film of the film roll is stretched.

9 Claims, 11 Drawing Sheets

(56) References Cited

U.S. PATENT DOCUMENTS

| | | | | |
|---|---|---|---|---|
| 2016/0355373 | A1* | 12/2016 | Yu Chen | B65H 23/14 |
| 2017/0305583 | A1* | 10/2017 | Nelson | B65H 16/005 |
| 2018/0065827 | A1* | 3/2018 | Nelson | B65H 16/005 |

* cited by examiner

STRETCH FILM DISPENSER WITH TENSION ADJUSTMENT DEVICE

FIELD OF THE INVENTION

The present invention relates to a stretch film dispenser, and more particularly to a stretch film dispenser with a tension adjustment device.

BACKGROUND OF THE INVENTION

In order to prevent damages to articles caused by shaking or falling during storage or transport, a stretch film dispenser is used for packing the articles. A conventional stretch film dispenser comprises a frame. The frame is provided with a film mounting unit and a film dispensing unit. The film mounting unit is provided with a film roll. A free end of the film roll is wound around the film dispensing unit. For packing an article, one end of the film is attached to the surface of the article, and then the frame is displaced for packing. However, when the article is packed, the film needs to generate tension to be tightly attached to the outside of the article. Therefore, an adjustment member is disposed on the top of the frame corresponding in position to the film dispensing unit. The adjustment member adjusts the tension of the film in a downward rotation manner.

However, the adjustment member is adjusted in a threaded stepless manner, so the time to adjust the adjustment member is long. After using for a period of time, the adjustment member may fall off and must be frequently adjusted. The packing process is quite complicated. In addition, the adjustment member is a screw. When the adjustment member is rotated in an opposite direction, the adjustment member may fall off easily. Accordingly, the inventor of the present invention has devoted himself based on his many years of practical experiences to solve these problems.

SUMMARY OF THE INVENTION

The primary object of the present invention is to provide a stretch film dispenser with a tension adjustment device, which can quickly adjust the tension of the film in a multi-stage manner to improve the tightness of the film attached to an article.

In order to achieve the aforesaid object, a stretch film dispenser with a tension adjustment device is provided. The stretch film dispenser comprises a frame. The film is provided with a film mounting unit and a film dispensing unit. The frame includes a coupling seat and a bottom seat. The coupling seat has a first through hole and a positioning hole in the vicinity of the first through hole. The positioning hole is provided with a positioning member. An adjustment rod has a first end connected to the frame and a second end positioned at the first through hole. The second end of the adjustment rod is provided with a first threaded portion. An adjustment unit is disposed on the coupling seat of the frame. The adjustment unit includes an adjustment seat. The adjustment seat is located at the first through hole. A bottom surface of the adjustment seat is provided with a plurality of positioning recesses corresponding to the positioning member. The positioning member is pressed against one of the plurality of positioning recesses. The adjustment seat is provided with a first screw hole. The first screw hole is threadedly connected with an adjustment member. A first end of the adjustment member is screwed to the first threaded portion of the adjustment rod. An elastic unit is connected to the film dispensing unit and the coupling seat.

When in use, the adjustment unit is rotated for the positioning member to be positioned in one of the positioning recesses having different depths. When the adjustment seat rotates along the second threaded portion to generate downward axial displacement, the bottom surface of the adjustment seat pushes the coupling seat. The coupling seat and the positioning member simultaneously push the elastic unit to press the film dispensing unit, so that the film dispensing unit may be in a different tension state when the film of the film roll is stretched.

DETAILED DESCRIPTION OF THE PREFERRED EMBODIMENTS

Embodiments of the present invention will now be described, by way of example only, with reference to the accompanying drawings.

Figure 1:
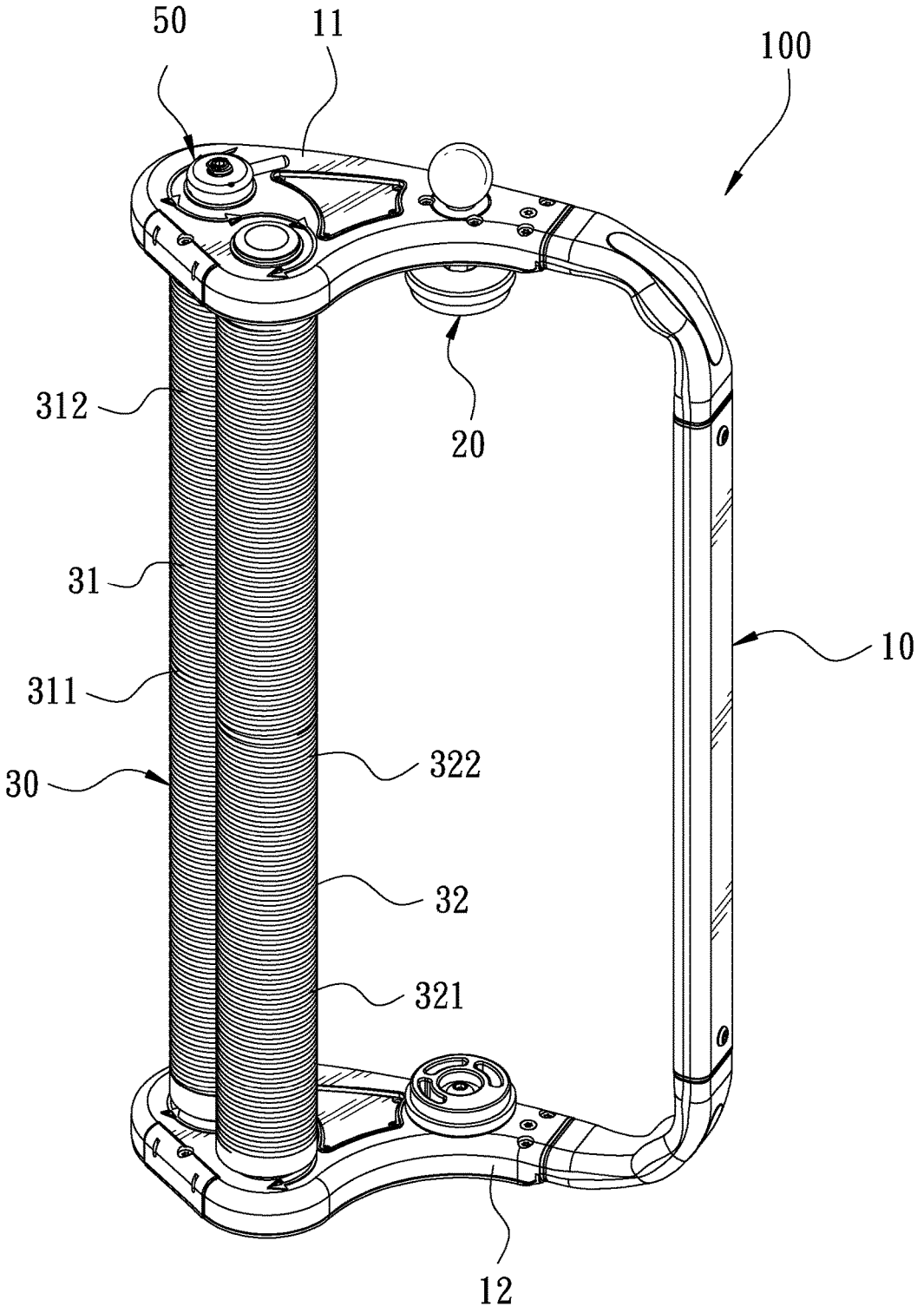
FIG. 1 is a perspective view in accordance with a preferred embodiment of the present invention.
Figure 2:
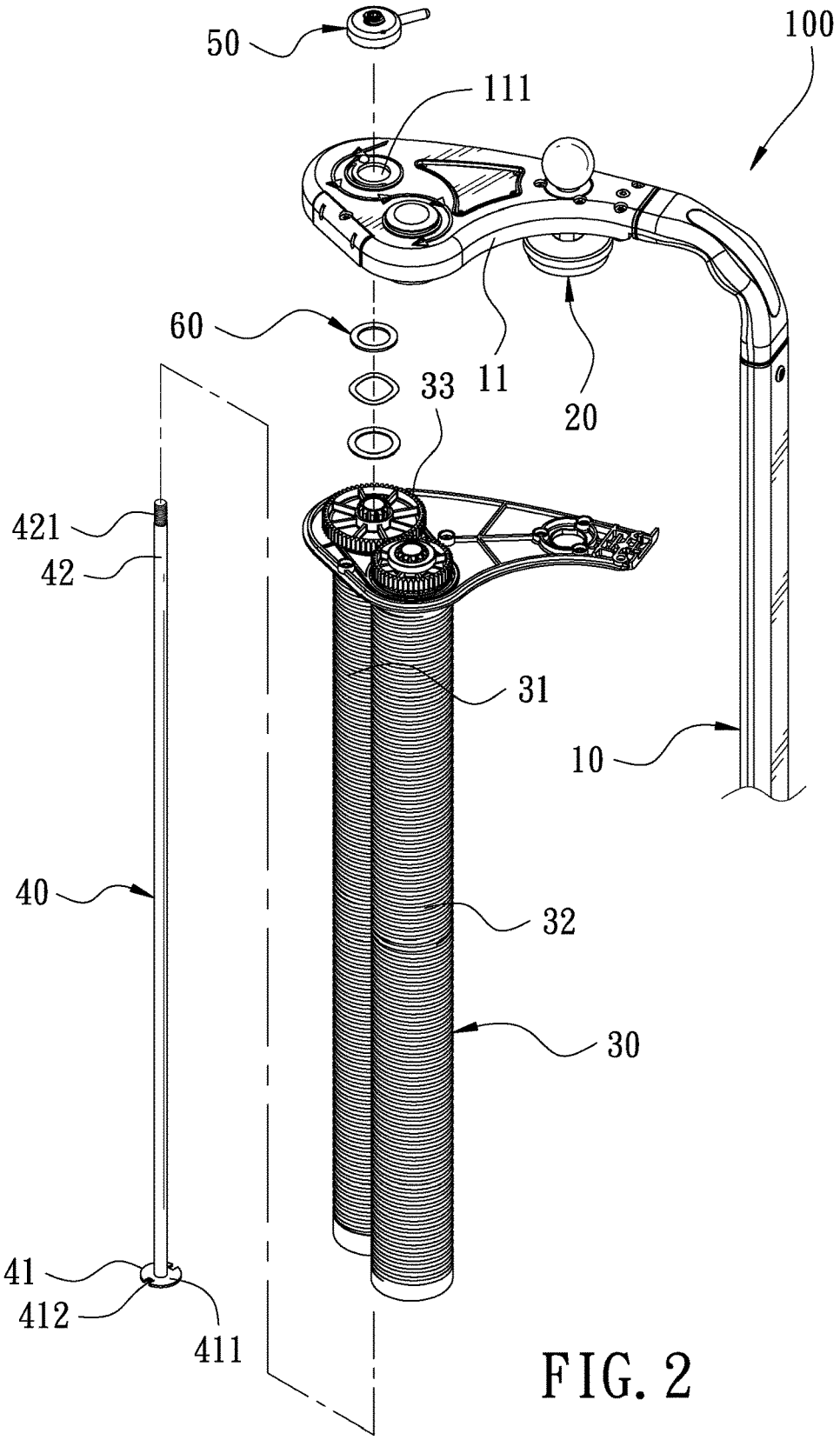
FIG. 2 is an exploded view of the film dispensing unit and the adjustment rod in accordance with the preferred embodiment of the present invention.
Figure 3:
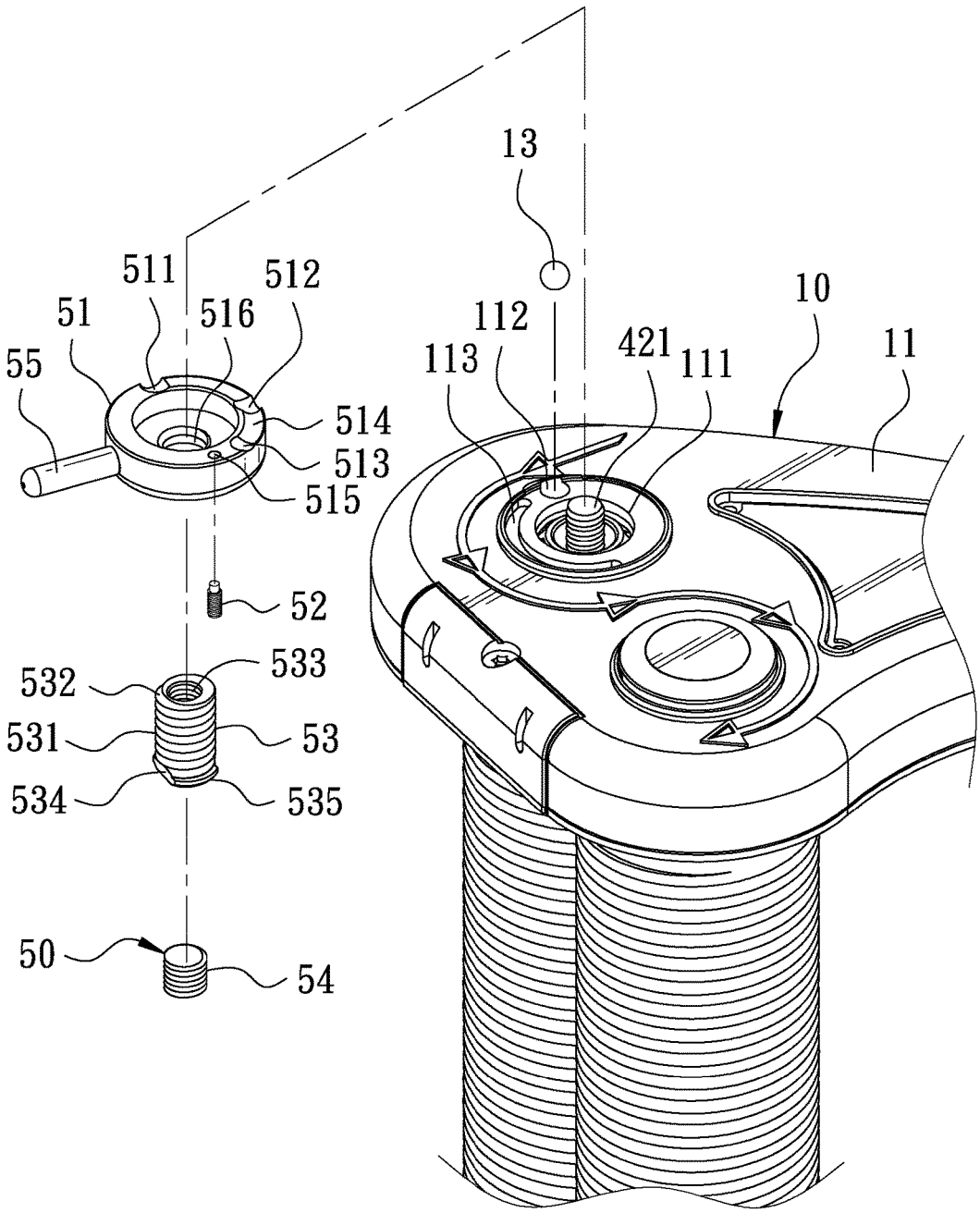
FIG. 3 is an exploded view of the adjustment unit in accordance with the preferred embodiment of the present invention.

FIG. 1 is a perspective view in accordance with a preferred embodiment of the present invention. FIG. 2 is an exploded view of a film dispensing unit and an adjustment rod in accordance with the preferred embodiment of the present invention. FIG. 3 is an exploded view of an adjustment unit in accordance with the preferred embodiment of the present invention. The present invention discloses a stretch film dispenser with a tension adjustment device. The tension adjustment device is mounted to a stretch film dispenser 100. The stretch film dispenser 100 comprises a frame 10. The film 10 is provided with a film mounting unit 20 and a film dispensing unit 30.

Figure 6:
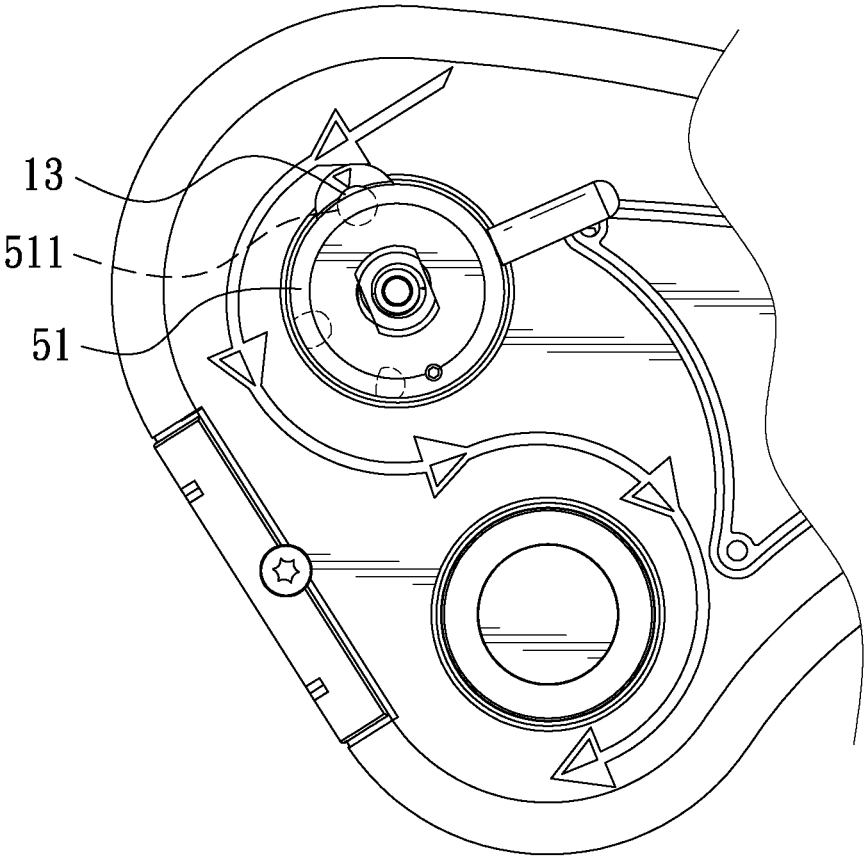
FIG. 6 is a schematic view of the adjustment seat located in the first position of the present invention.
Figure 7:
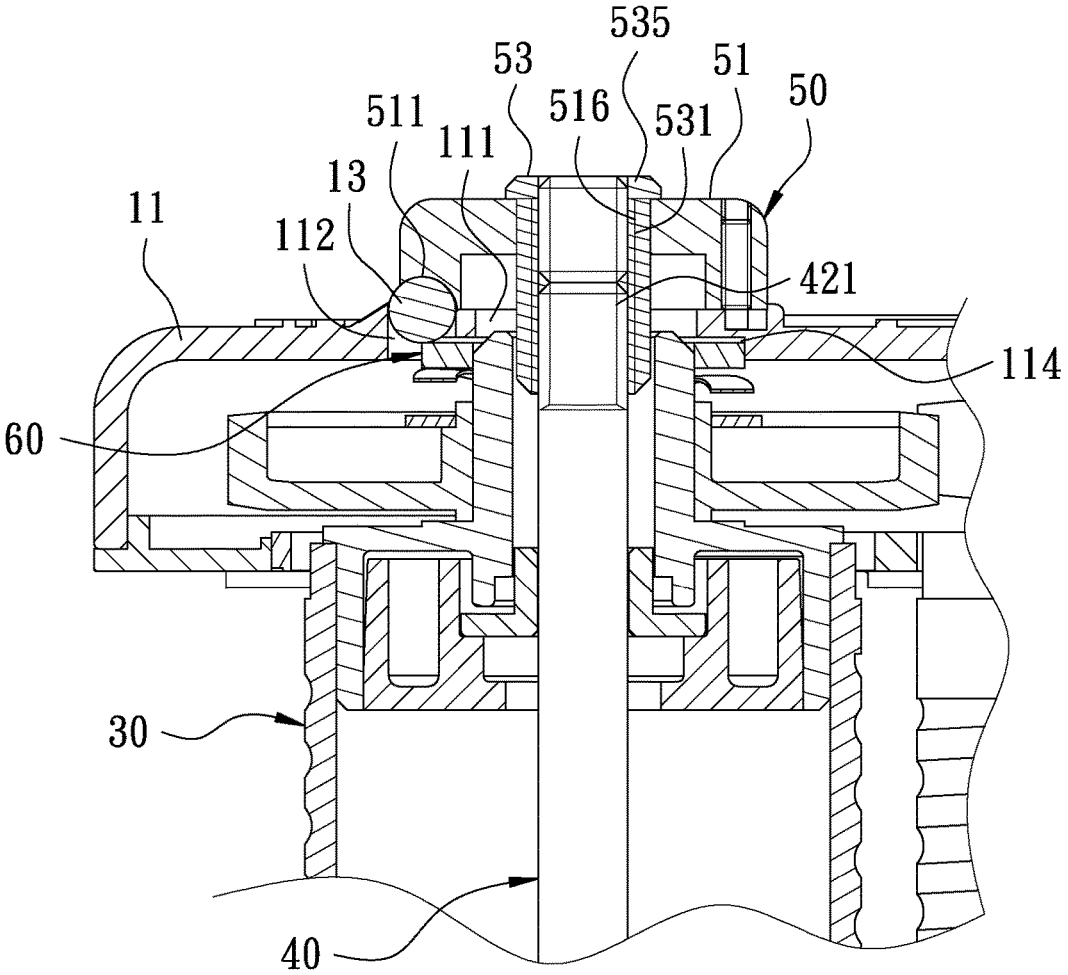
FIG. 7 is a partially sectional view of the adjustment seat located in the first position of the present invention.

The frame 10 includes a coupling seat 11 and a bottom seat 12. As shown in FIG. 6 and FIG. 7, the coupling seat 11 has a first through hole 111 and a positioning hole 112 in the vicinity of the first through hole 111. The positioning hole 112 is provided with a positioning member 13. In this embodiment, the positioning member 13 is a ball. The top surface of the coupling seat 11 is provided with an arc groove 113 around the outer periphery of the first through hole 111. The bottom surface of the coupling seat 11 is provided with a recess 114. The recess 114 communicates with the first through hole 111 and the positioning hole 112. Please refer to FIG. 4. The bottom seat 12 has a second through hole 121. The peripheral wall of the second through hole 121 is provided with two protrusions 122.

The film dispensing unit 30 includes a first roller 31 and a second roller 32. The central axis of the first roller 31 is concentric with the central axis of the first through hole 111. The outer peripheral walls of the first roller 31 and the second roller 32 or a combination thereof are provided with extension members 311, 321. In this embodiment of the present invention, the outer peripheral walls of the first roller 31 and the second roller 32 are circumferentially provided with extension members 311, 321, respectively. The extension members 311, 321 are respectively provided with screw threads 312, 322 extending from the middle portions toward respective two ends of the first roller 31 and the second roller 32. The top end of the film dispensing unit 30 is provided with a gear set 33.

An adjustment rod 40 has a fixing portion 411 at a first end 41. The fixing portion 411 is mounted to the second through hole 121 of the bottom seat 12. The fixing portion 411 is formed with engaging notches 412 corresponding to the protrusions 122. The engaging notches 412 are engaged with the protrusions 12 respectively for fixing the adjustment rod 40, so that the adjustment rod 40 won't be rotated. The adjustment rod 40 has a second end 42 inserted through the first roller 31 of the film dispensing unit 30 and positioned at the first through hole 111 of the frame 10. The second end 42 of the adjustment rod 40 is provided with a first threaded portion 421.

Figure 4:
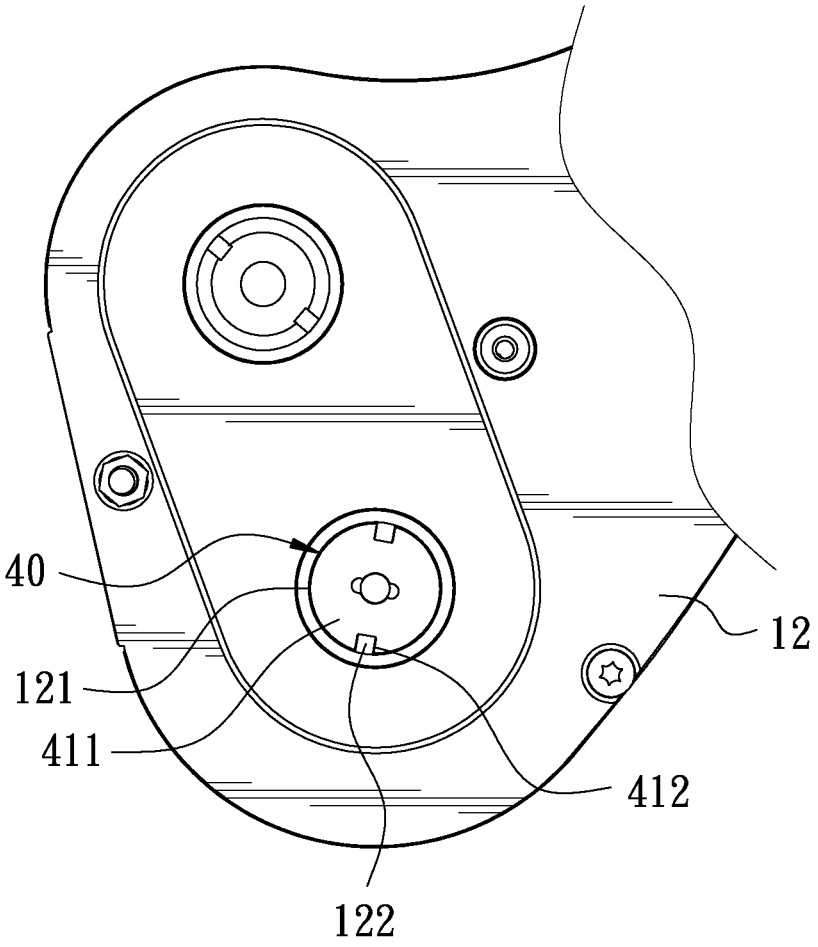
FIG. 4 is a bottom view of the bottom seat in accordance with the preferred embodiment of the present invention.
Figure 5:
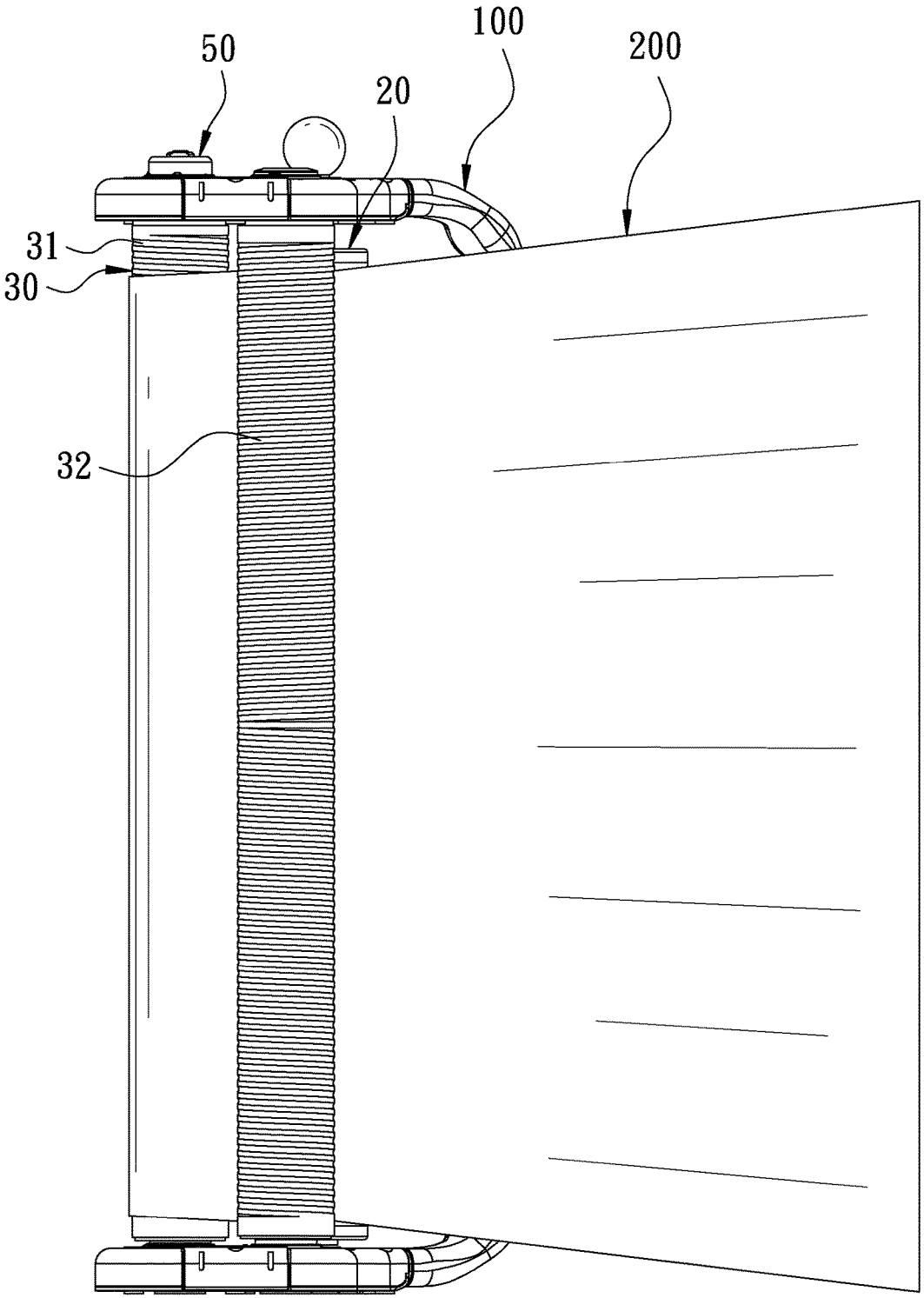
FIG. 5 is a schematic view in accordance with the preferred embodiment of the present invention, showing that the film of the film roll stretched.

An adjustment unit 50 is disposed on the coupling seat 11 of the frame 10. Referring to FIG. 4 and FIG. 5, the adjustment unit 50 includes an adjustment seat 51 that is disposed at the first through hole 111. The bottom surface of the adjustment seat 51 is provided with a plurality of positioning recesses 511, 512, 513 corresponding to the positioning member 13. In this embodiment, the depths of the positioning recesses 511, 512, 513 are different. The positioning member 13 is pressed against one of the plurality of positioning recesses 511, 512, 513. The bottom surface of the adjustment seat 51 is provided with a slide groove 514. The slide groove 514 is located between the positioning recesses 511, 512, 513. In this embodiment, the slide groove 514 is arcuate. The adjustment seat 51 is provided with a limiting hole 515 corresponding in position to the arc groove 113. The limiting hole 515 is provided with a limiting member 52. A free end of the limiting member 52 is accommodated in the arc groove 113, such that the arc groove 113 is configured to limit the rotation of the adjustment seat 51. The adjustment seat 51 is provided with a first screw hole 516. The first screw hole 516 is threadedly connected with an adjustment member 53. The outer peripheral wall of the adjustment member 53 is provided with a second threaded portion 531 corresponding to the first screw hole 516. The outer diameter of the second threaded portion 531 is greater than the outer diameter of the first threaded portion 421. A first end 532 of the adjustment member 53 is provided with a second screw hole 533. The second screw hole 533 of the adjustment member 53 is screwed to the first threaded portion 421 of the adjustment rod 40. A second end 534 of the adjustment member 53 is threadedly connected with a screw 54. The second end 534 of the adjustment member 53 is provided with a stopping portion 535. The stopping portion 535 is located at the top of the adjustment seat 51 to prevent the adjustment seat 51 from jumping when it is excessively rotated. Besides, the side wall of the adjustment seat 51 is provided with an operating member 55 for rotating the adjustment seat 51.

An elastic unit 60 is connected to the film dispensing unit 30 and the coupling seat 11, and is located in the recess 114 of the coupling seat 11. As shown in FIG. 7, the elastic unit 60 is located between the first through hole 111 and the gear set 33. In the embodiment, the elastic unit 60 is composed of a plurality of elastic pieces.

Referring to FIG. 5, when the stretch film dispenser 100 is used, a film roll 200 is first mounted to the film mounting unit 20, and then the film of the film roll 200 is wound around the film dispensing unit 30 so that the stretch film dispenser 100 can be used for packing articles.

Please refer to FIG. 6 and FIG. 7. When the tension of the film of the film roll 200 is to be adjusted, the adjustment seat 51 is first adjusted to the position of the positioning recess 512 having the maximum depth so that the positioning member 13 is positioned at the positioning recess 512. When the adjustment seat 51 rotates along the second threaded portion 531 to generate downward axial displacement, the bottom surface of the adjustment seat 51 pushes the coupling seat 11. The coupling seat 11 and the positioning member 13 simultaneously push the elastic unit 60 to press the film dispensing unit 30, so that the film dispensing unit 30 stretches the film of the film roll 200 in a loose manner.

Figure 8:
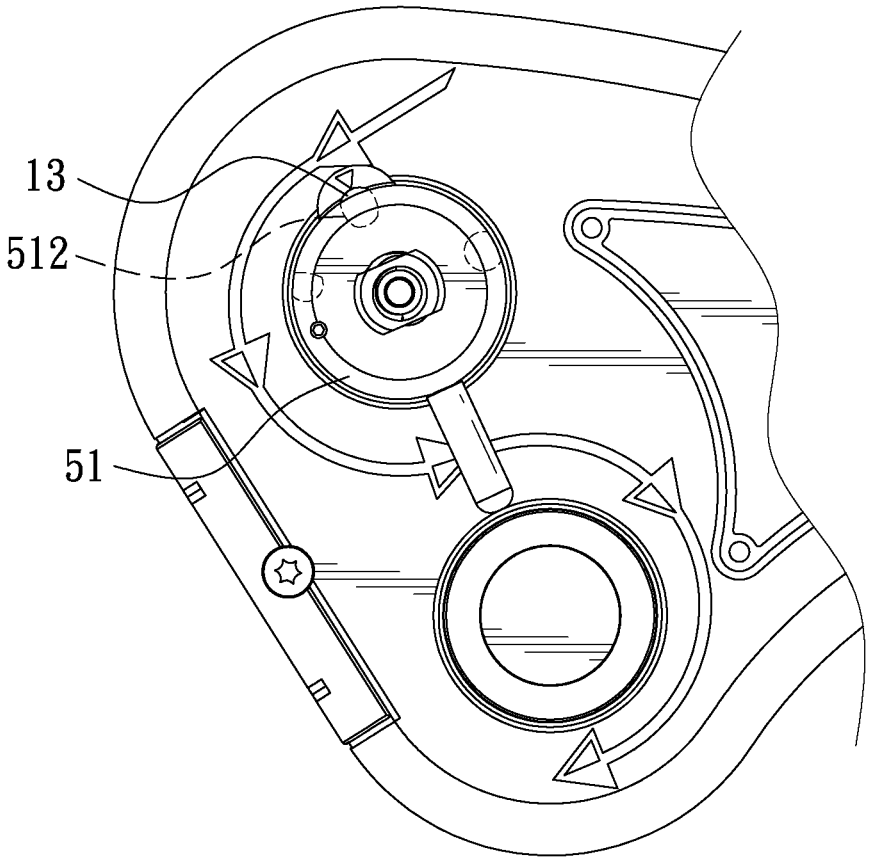
FIG. 8 is a schematic view of the adjustment seat located in the second position of the present invention.
Figure 9:
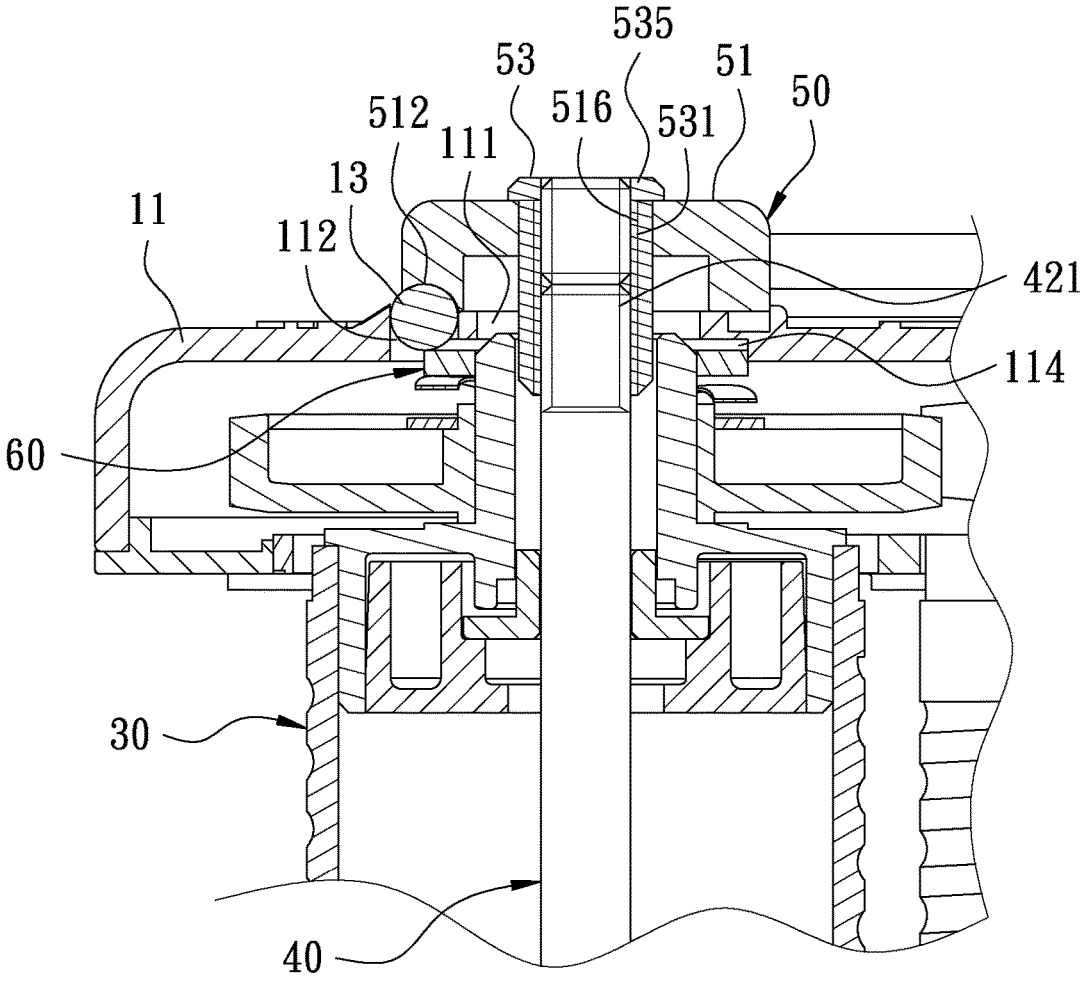
FIG. 9 is a partially sectional view of the adjustment seat located in the second position of the present invention.

Referring to FIG. 8 and FIG. 9, when the adjustment seat 51 is adjusted to the position of the positioning recess 513 having an intermediate depth, the positioning member 13 is positioned at the positioning recess 513. When the adjustment seat 51 rotates along the second threaded portion 531 to generate downward axial displacement, the bottom surface of the adjustment seat 51 pushes the coupling seat 11. The coupling seat 11 and the positioning member 13 simultaneously push the elastic unit 60 to press the film dispensing unit 30, so that the film dispensing unit 30 stretches the film of the film roll 200 in a moderate manner.

Figure 10:
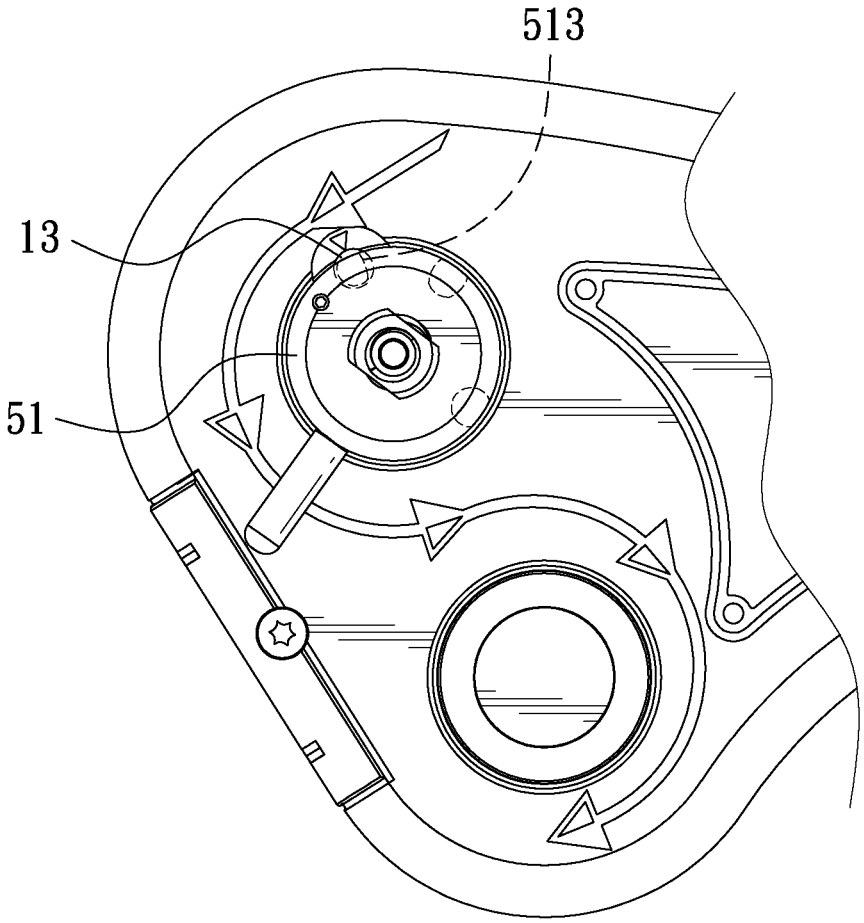
FIG. 10 is a schematic view of the adjustment seat located in the third position of the present invention.
Figure 11:
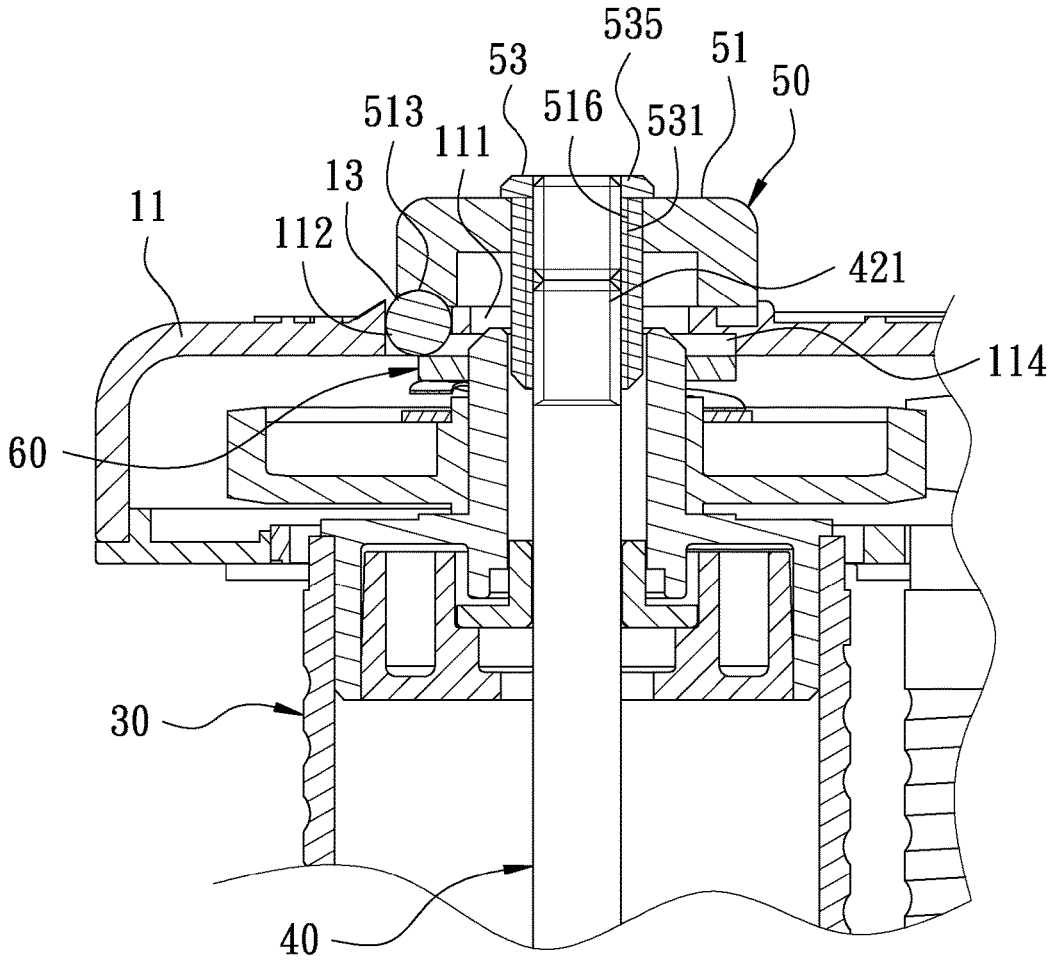
FIG. 11 is a partially sectional view of the adjustment seat located in the third position of the present invention.

Referring to FIG. 10 and FIG. 11, when the adjustment seat 51 is adjusted to the position of the positioning recess 514 having the minimum depth so that the positioning member 13 is positioned at the positioning recess 514. When the adjustment seat 51 rotates along the second threaded portion 531 to generate downward axial displacement, the bottom surface of the adjustment seat 51 pushes the coupling seat 11. The coupling seat 11 and the positioning member 13 simultaneously push the elastic unit 60 to press the film dispensing unit 30, so that the film dispensing unit 30 stretches the film of the film roll 200 in a tight manner.

It is to be noted that the engaging notches 412 of the fixing portion 411 are respectively engaged with the protrusions 122 of the second through hole 121 to fix the adjustment rod 40. When the adjustment seat 51 is rotated along the second threaded portion 531, the engaging notches 412 of the adjustment rod 40 are engaged with the protrusions 122 without rotating, so that the adjustment seat 51 can exactly adjust the tension of the film. The outer diameter of the second threaded portion 531 of the adjustment member 53 is greater than the outer diameter of the first threaded portion 421 of the adjustment rod 40 to increase the distance generated by the axial displacement when the adjustment seat 51 is rotated along the second threaded portion 531, such that the adjustment seat 51 can quickly adjust the force of the coupling seat 11 and the positioning member 13 to push the film dispensing unit 30.

It is worth mentioning that the limiting hole 515 of the adjustment seat 51 is provided with the limiting member 52, and the free end of the limiting member 52 is confined in the arc groove 113 to limit the rotation of the adjustment seat 51. The second end 534 of the adjustment member 53 is provided with the stopping portion 535, which can prevent the adjustment seat 51 from being excessively rotated to cause disengagement, thereby making the adjustment seat 51 have the effect of not easily falling off.

Referring to FIG. 5, the outer peripheral walls of the first roller 31 and the second roller 32 of the film dispensing unit 30 are provided with the screw threads 311, 321. When the film of the film roll 200 passes through the surfaces of the first roller 31 and the second roller 32, two sides of the film of the film roll 200 will be stretched outward along the screw threads 312, 322 of the first roller 31 and the second roller 32. In addition to flattening the film of the film roll 200, the film of the film roll 200 is closely attached to the outer side of the article.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A stretch film dispenser with a tension adjustment device, the stretch film dispenser comprising a frame, the film being provided with a film mounting unit and a film dispensing unit, characterized by:

the frame including a coupling seat and a bottom seat, the coupling seat having a first through hole and a positioning hole in the vicinity of the first through hole, the positioning hole being provided with a positioning member;

an adjustment rod having a first end connected to the frame and a second end positioned at the first through hole, the second end of the adjustment rod being provided with a first threaded portion;

an adjustment unit disposed on the coupling seat of the frame, the adjustment unit including an adjustment seat, the adjustment seat being located at the first through hole, a bottom surface of the adjustment seat being provided with a plurality of positioning recesses corresponding to the positioning member, the positioning member being pressed against one of the plurality of positioning recesses, the adjustment seat being provided with a first screw hole, the first screw hole being threadedly connected with an adjustment member, a first end of the adjustment member being screwed to the first threaded portion of the adjustment rod;

an elastic unit connected to the film dispensing unit and the coupling seat.

2. The stretch film dispenser with the tension adjustment device as claimed in claim 1, wherein the first end of the adjustment member is provided with a second screw hole, the first end of the adjustment member is screwed to the first threaded portion of the adjustment rod, a second end of the adjustment member is threadedly connected with a screw, the second end of the adjustment member is provided with a stopping portion, and the stopping portion is located at a top of the adjustment seat.

3. The stretch film dispenser with the tension adjustment device as claimed in claim 1, wherein the bottom seat has a second through hole, a peripheral wall of the second through hole of the bottom seat is provided with a plurality of protrusions, the first end of the adjustment rod has a fixing portion, the first end of the adjustment rod is connected to the second through hole of the bottom seat, the fixing portion is formed with engaging notches corresponding to the protrusions, the engaging notches are engaged with the protrusions respectively, and the second end of the adjustment rod is inserted through the film dispensing unit.

4. The stretch film dispenser with the tension adjustment device as claimed in claim 1, wherein an outer peripheral wall of the adjustment member is provided with a second threaded portion corresponding to the first screw hole, and the second threaded portion has an outer diameter greater than that of the first threaded portion.

5. The stretch film dispenser with the tension adjustment device as claimed in claim 1, wherein a top surface of the coupling seat is provided with an arc groove around an outer periphery of the first through hole, the adjustment seat is provided with a limiting hole corresponding in position to the arc groove, the limiting hole is provided with a limiting member, and a free end of the limiting member is accommodated in the arc groove for limiting rotation of the adjustment seat.

6. The stretch film dispenser with the tension adjustment device as claimed in claim 1, wherein the positioning recesses have different depths, the bottom surface of the adjustment seat is provided with a slide groove, and the slide groove is located between the positioning recesses.

7. The stretch film dispenser with the tension adjustment device as claimed in claim 1, wherein the elastic unit is composed of a plurality of elastic pieces.

8. The stretch film dispenser with the tension adjustment device as claimed in claim 1, wherein the film dispensing unit includes a first roller and a second roller, outer peripheral walls of the first roller and the second roller or a combination thereof are provided with extension members, and the extension members are respectively provided with screw threads extending from middle portions toward respective two ends of the first roller and the second roller.

9. The stretch film dispenser with the tension adjustment device as claimed in claim 1, wherein a bottom surface of the coupling seat is provided with a recess, the recess communicates with the first through hole and the positioning hole, and the elastic unit is located in the recess of the coupling seat.

* * * * *